US005118136A

United States Patent [19]

Johnson

[11] Patent Number: 5,118,136

[45] Date of Patent: Jun. 2, 1992

[54] PORTABLE SEAT FOR A SKIER

[76] Inventor: Mary D. Johnson, 1712 Road 84, Pasco, Wash. 99301

[21] Appl. No.: 637,279

[22] Filed: Jan. 3, 1991

[51] Int. Cl.[5] ..... A63C 11/00

[52] U.S. Cl. ..... 280/812

[58] Field of Search ..... 280/809, 812, 814, 816, 280/820, 826

[56] References Cited

U.S. PATENT DOCUMENTS 2,122,347 6/1938 Lasch ..... 280/812

FOREIGN PATENT DOCUMENTS 170451 2/1952 Fed. Rep. of Germany ..... 280/812

1383879 11/1964 France ..... 280/812

2444429 8/1980 France ..... 280/812

2572297 5/1986 France ..... 280/812

*Primary Examiner*—Andres Kashnikow

*Assistant Examiner*—Richard Camby

[57] ABSTRACT

A seat utilizing a pair of skis and a pair of ski poles as a frame including a cloth-like seat having the ski poles attached at opposite end with portions of each ski pole extending beyond side edges of the seat. One ski pole is attached to the tip of each ski by way of a strap member with end portions of the skis extending beyond the edge of the seat being supported on an upper surface of each ski when the skis are inserted in the snow with the upper surfaces being coplanar and facing angularly upward.

1 Claim, 1 Drawing Sheet

PORTABLE SEAT FOR A SKIER

BACKGROUND OF THE INVENTION

This invention relates to seats. More particularly, the invention relates to a portable seat for use by a snow skier.

Snow skiing is very popular and anyone who skis know how crowded todays ski lodges can be. Not infrequently, it is either impossible to obtain a seat on which to rest or relax between periods of skiing in today's ski lodges simply because all such seats are typically always occupied during the peak skiing periods of the day. Frequently, skiers simply end up standing, leaning against structures or sitting on floors or on make shift seats including equipment, coats or whatever object may be available.

Also, cross country skiers, as opposed to downhill skiers, traverse substantially long distances over the countryside and when, required to rest or merely to relax for a period of time, must also make due with whatever natural objects provide some semblance of a seat on which to sit.

Accordingly, it is the object of the present invention to provide for a portable seat that can be either carried by a skier, for example the cross country skier, or stored and erected when desired. Such seat must therefore be portable, small, have a minimum number of parts providing for fast, easy erection and disassembly. The present invention provides for such a seat not heretofore available.

SUMMARY OF THE INVENTION

According to the invention, there is provided a seat arrangement that utilizes the skier's skis and ski poles as a seat frame to which is attached a cloth seat member.

According to the invention, the skier's skis are inserted into the snow in a spaced apart relationship with the ski tips pointing upward and the upper surfaces of the skies being coplanar and facing angularly upwardly.

According to an important feature of the invention, there is provided a cloth member having means at opposing ends for removably attaching respective ones of the ski poles such that portions of opposite ends of each ski pole extend beyond the side edges of the cloth member.

According to another feature of the invention, there is provided means for removably attaching one of the ski poles to each of the skis proximate the tip end of the ski with the portion of each pole that extends beyond the side edges of the cloth member engaging against the upper surface of each ski.

According to the preferred embodiment, the means for attaching the one ski pole to the skis includes a pair of nonelastic, flexible double-loop straps each having one loop encircling the ski pole at one of the respective portions of the pole that extends beyond the side edges of the cloth member and the other loop of each strap respectively engaged around the tapered forward tip of each ski.

According to the preferred embodiment, one loop of the double-loop strap is provided with a cross strap connected between opposing locations along the length of the one loop which cross strap sub-divides the one loop into additional inner and outer loops, the outer one of which engages over the tapered tip of the ski with the cross strap securely engaged against the upper surface of the skis so that the strap is tightly but removably secured to the skitip with the ski pole and cloth member hanging from the ski tip and supported on the skis' upper surfaces.

According to yet another important feature of the invention, the means for attaching the ski poles to the opposite ends of the cloth member includes a belt loop type attachment at each end of the cloth member wherein the cloth member is folded back over itself and the resulting overlapping portions are secured together by a seam to form the belt loop through which the ski pole is inserted.

Another important feature of the invention provides for the cloth member to included two parallel belt loop-type attachments at one end providing for changing the spacing between the top and bottom seat supports formed by the ski poles to change the length of the cloth member seat.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
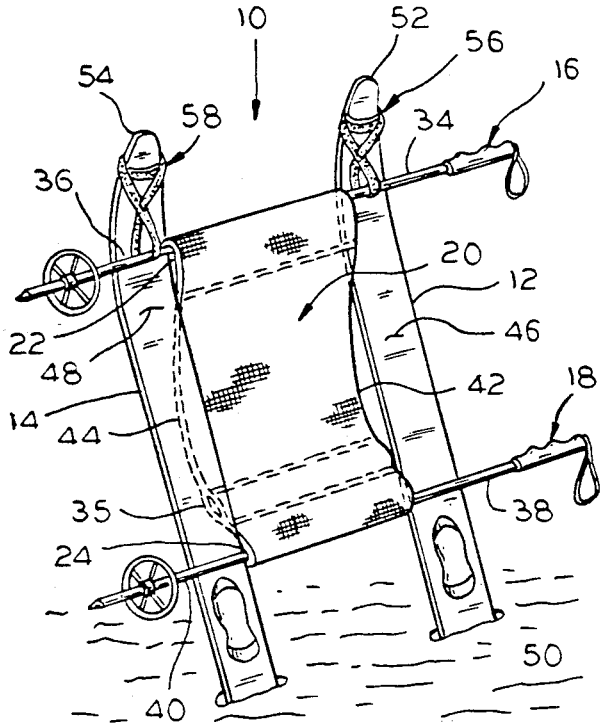
FIG. 1 is a pictorial view of the seating arrangement according to the invention showing details of construction and use.
Figure 2:
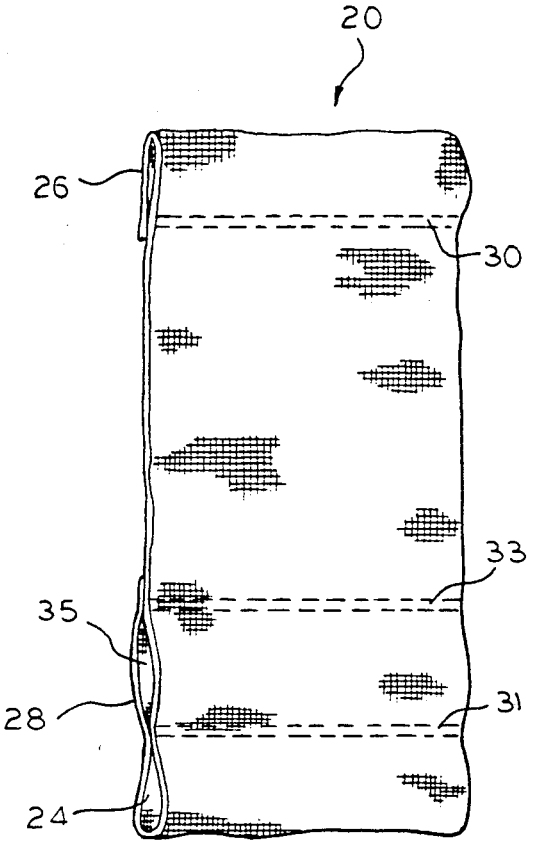
FIG. 2 is a perspective view of a preferred cloth member of the seat showing details of construction.

Shown in FIG. 1 is a seat arrangement 10 utilizing a pair of snow skis 12, 14 and a pair of skis poles 16, 18 as a frame. The arrangement includes a rectangular seat member 20 made from a cloth or fabric preferably of a water proof material such as for example nylon or other synthetic material which is adapted to removably attach one of the ski poles at each of its opposite ends. Attachment of the poles is achieved in the preferred embodiment as shown in FIGS. 1 and 2 by way of belt loop-type attachments or curtain rod-like pockets 22, 24 provided along the ends of the seat member. The attachment pockets are formed by folding end portions 26, 28 of the cloth seat member back over itself and sewing or otherwise securing the overlapping portions together along seams 30, 31. As shown in FIG. 2, one end, lower end, of the seat member is provided with an additional seam 33 forming an additional rod pocket 35 or belt loop-type attachment at the lower end parallel to the one pocket 24. The two rod pockets provide for changing the spacing between the seat supports formed by the ski poles by alternatively locating the lower ski pole at either one of two positions along the length of the seat member to accommodate persons of different size. Of course, more than one additional pole attachment could be provided at the lower end, but it has been found that two pockets is sufficient to accommodate the majority of skiers.

Figure 4:
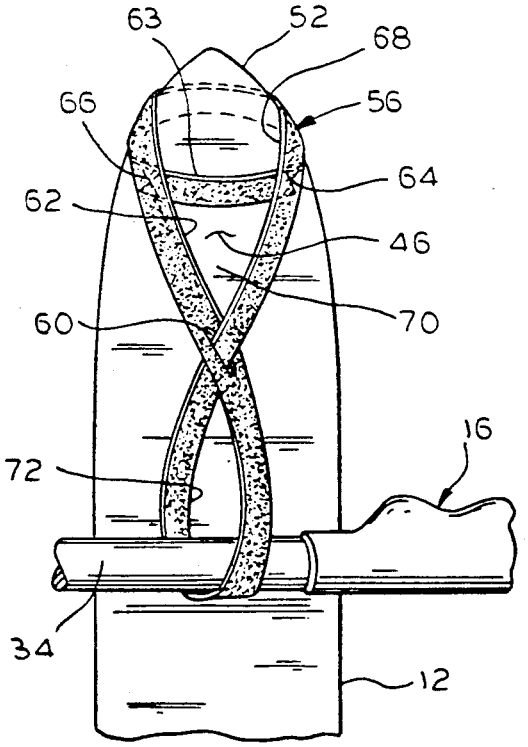
FIG. 4 is an enlarged partial view of the forward tapered tip portion of a ski showing the strap member of FIG. 3 in use.
Figure 3:
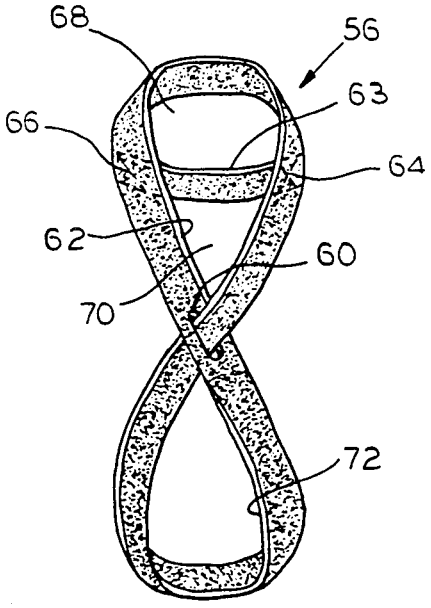
FIG. 3 is a planned view of a preferred strap attachment member showing details of construction.

Referring to FIGS. 1, 3 and 4 it can be seen that the width of the seat member, which is preferably on the order of about 30", is sized to comfortably accommodate most individuals and to allow portions 34, 36 and 38, 40 of the respective ski poles to extend beyond the side edges 42, 44 of the seat member. The extending pole portions 34, 36 and 38, 40 engage against the angularly, upwardly facing coplanar upper surfaces 46, 48 of the skis when inserted into a depth of snow 50 sufficient to hold the skis as described below.

The upper ski pole 16 is attached to the tapered tip portion 52, 54 of each ski so as to be removable and to securely hang from the ski tips with the extending portions of each pole engaging against the upper surfaces of the skis as shown in the drawings. As shown in FIG. 1, attachment of the upper pole to each ski is accomplished by a pair of non-elastic but flexible straps 56, 58. Both attachment straps are identical and the following description when referring to FIGS. 3 and 4, wherein only one strap 56 and one ski 12 are shown, is applicable to both straps. The preferred attachment strap is shown in FIG. 3 and is made from a length of nonelastic, flexible material, such as nylon, having an aperture 60 along its length through which the strap is threaded with its ends secured together, for example, by sewing forming an endless figure eight-shaped, double loop member. The top loop 62 of the figure eight-shaped strap is provided with a cross strap 63 sewed to the main strap loop at opposite locations 64, 66 to sub-divide the top loop into two smaller outer and inner loops 68, 70. As shown in FIG. 4, the cross strap 63 is positioned to size the outer loop portion 68 for receipt over and engagement around the tapered tip portion 52 of the ski 12 with the cross strap 62 engaged to the upper surface 46 of the skis such that the strap outer loop portion 68 is securely engaged around the ski tip 52 with the ski tip 52 wedged into the loop 68 when the strap is downwardly loaded by the weight of the user. As shown in FIGS. 1 and 4, a lower loop 72 of each strap encircles the respective portions 34, 36 of the upper ski pole 16 that extend beyond the side edges of the seat member.

In order to use the seat, the user only need locate a depth of snow sufficient to hold the two skis in an inclined position when inserted into the snow. Once locating such snow, the user inserts the heel or trailing end of each ski into the snow to a depth of preferable about twelve to eighteen inches with the skis spaced apart sufficiently to receive the width of the seat member between the skis with clearence but not greater than the length of his ski poles. The skis are orientated inclined at an angle of about sixty degrees from the horizontal with the upper surfaces being coplanar. The user then inserts one of his ski poles, handle first, through the lower loop of one of the attachment straps, through the upper attachment pocket in the upper end of the seat member and then through the lower loop of the second attachment strap. The other ski pole is inserted, handle first, through one of the rod pockets at the lower end of the seat member and finally the outer, uppermost loops of the strap attachment members are positioned over the tips of the respective skis with the extending portions of each ski pole engaged against the upper surface of each ski. With the seat so attached, and being careful not to sit directly on or bear his weight directly on the lower ski pole, the user can then sit on the seat member with the lower ski pole positioned generally beneath his knee or thigh area. It has been found that the seating arrangement according to this disclosure adequately supports normal size adults and can be adjusted to accommodate children as well.

Having described the preferred embodiment of the invention, those skilled in the art, having the benefit of this description and the accompanying drawings can readily devise other embodiments and modifications of the invention which other embodiments and modifications are to be considered to be within the scope of the appended claims.

What is claimed is:

1. A seat for a skier comprising in combination:

a pair of skis inserted in snow in spaced apart relationship with upper surfaces of said pair of skis being coplanar and facing angularly upward;

a pair of ski poles;

a cloth-like member having means along opposing ends for removably attaching a respective one of said pair of ski poles with portions of each said ski pole extending beyond opposite side edges of said cloth like member; and strap means for hanging one of said ski poles from forward tip portions of each of said skis with said portions of each said ski pole that extend beyond said side edges of said cloth-like member respectively supported on the upper surface of each said ski wherein said strap means includes a pair of figure eight configured flexible members, one loop of each said figure eight configured member including a flexible cross strap portion connected between generally opposite locations along said one loop subdividing said one loop of each said figure eight configured member into outer and inner loop portions, the outer loop portion of each of said flexible members engaged around a tapered tip portion of a respective one of said pair of skis with said cross strap engaged against the outer surface of said ski.

* * * * *